US008297260B2

(12) United States Patent
Masuda

(10) Patent No.: US 8,297,260 B2
(45) Date of Patent: Oct. 30, 2012

(54) FUEL SUPPLY SYSTEM

(75) Inventor: Kengo Masuda, Kariya (JP)

(73) Assignee: Denso Corporation, Kariya (JP)

( * ) Notice: Subject to any disclaimer, the term of this patent is extended or adjusted under 35 U.S.C. 154(b) by 331 days.

(21) Appl. No.: 12/683,559

(22) Filed: Jan. 7, 2010

(65) Prior Publication Data

US 2010/0192922 A1 Aug. 5, 2010

(30) Foreign Application Priority Data

Jan. 30, 2009 (JP) ..... 2009-19815

(51) Int. Cl.
*F02M 37/04* (2006.01)
*B65D 41/56* (2006.01)
*B65D 51/00* (2006.01)

(52) U.S. Cl. ..... 123/509; 220/212

(58) Field of Classification Search ..... 123/509, 123/497, 514; 439/540.1, 660, 680, 378, 439/586; 264/255
See application file for complete search history.

(56) References Cited

U.S. PATENT DOCUMENTS

| | | | | |
|---|---|---|---|---|
| 5,342,221 | A * | 8/1994 | Peterson | 439/677 |
| 5,674,094 | A * | 10/1997 | Hutchinson et al. | 439/680 |
| 6,159,054 | A * | 12/2000 | Ko | 439/680 |
| 2004/0020839 | A1 | 2/2004 | Kato et al. | |
| 2006/0211274 | A1 | 9/2006 | Sai | |
| 2006/0219318 | A1* | 10/2006 | Crary | 141/286 |
| 2007/0044772 | A1 | 3/2007 | Sakamoto et al. | |

FOREIGN PATENT DOCUMENTS

| | | |
|---|---|---|
| JP | 10-003963 | 1/1998 |
| JP | 2001-309528 | 11/2001 |
| JP | 2002-193086 | 7/2002 |
| JP | 2003-077582 | 3/2003 |
| JP | 2003-201932 | 7/2003 |
| JP | 2007-227257 | 9/2007 |
| JP | 2007-270627 | 10/2007 |
| JP | 2008-196440 | 8/2008 |
| JP | 2008-243569 | 10/2008 |

OTHER PUBLICATIONS

PFD titled"Wire Seal".*
PFD titled "weatherpack".*
Japanese Office Action dated Jan. 11, 2011, issued in corresponding Japanese Application No. 2009-019815 with English Translation.

* cited by examiner

*Primary Examiner* — Stephen K Cronin
*Assistant Examiner* — Sherman Manley
(74) *Attorney, Agent, or Firm* — Nixon & Vanderhye PC

(57) ABSTRACT

A fuel supply system includes a covering member, a subtank, a first housing on the covering member to project toward the subtank, terminals in the first housing, a second housing fitted to the first housing, and lead wires in the second housing connected respectively to the terminals. The first housing includes a fitting recess opening toward the subtank, and a partition wall dividing the recess into spaces, each of which receives a corresponding terminal. The second housing includes a fitting projection fitted into the recess, a slit dividing the projection into blocks, each of which receives a corresponding terminal, the partition wall being inserted in the slit, and axial holes, each of which accommodates a corresponding wire. Each wire includes a corresponding one of elastic seal members. Each seal member seals a gap between a corresponding wire and a wall surface of a corresponding axial hole.

10 Claims, 3 Drawing Sheets

FUEL SUPPLY SYSTEM

CROSS REFERENCE TO RELATED APPLICATION

This application is based on and incorporates herein by reference Japanese Patent Application No. 2009-19815 filed on Jan. 30, 2009.

BACKGROUND OF THE INVENTION

1. Field of the Invention

The present invention relates generally to a fuel supply system that supplies fuel stored in a fuel tank to an internal combustion engine, and more particularly to a fuel supply system provided with a connector joining device. The connector joining device includes an electric connector and another electric connector (coupler). The electric connector is disposed on a covering member for covering an opening of a fuel tank, and the another electric connector accommodates a lead wire connected to a terminal of the electric connector.

2. Description of Related Art

Conventionally, an in-tank type fuel supply system having a pump module that is accommodated in a fuel tank is widely known (see, for example, JP-A-2008-196440). The fuel supply system includes a covering member, a subtank, and a pump module. The covering member closes an opening of the fuel tank formed at an upper wall part thereof. The subtank is disposed in the fuel tank. The pump module is accommodated in the subtank. The pump module includes a fuel pump and a fuel filter. The fuel pump suctions and then discharges fuel after pressurizing it, and the fuel filter is disposed to surround the fuel pump in an outer peripheral direction thereof. An electric connector is provided for the covering member so as to project from a lower surface of the covering member in a direction of gravitational force thereof toward the subtank. This electric connector is connected to another electric connector (coupler).

A connector joining device, which connects the electric connector disposed on the covering member that covers the opening of the fuel tank and the electric connector (coupler) as its counterpart, may have the following three constitutions. The connector joining device with the first constitution may include an electric connector including a first housing and an electric connector (coupler) including a second housing. A recess having two male terminals together is formed on the first housing, and a projection that is to be fitted into the recess of the first housing is formed on the second housing. In this connector joining device, the two male terminals that coexist in the recess and two female terminals accommodated in the projection are connected.

The connector joining device with the second constitution may include an electric connector including a first housing and an electric connector (coupler) including a second housing. A recess that has an independent space for each male terminal to limit creepage surface leakage current is formed on the first housing. A projection that is to be fitted into the recess is formed for each female terminal on the second housing. The connector joining device with the third constitution may include an electric connector including a first housing, an electric connector (coupler) including a second housing, a first sealing member, and a second sealing member. A recess having two male terminals together is formed on the first housing, and a projection that is to be fitted into the recess of the first housing is formed on the second housing. The first sealing member seals the two female terminals accommodated in the projection from the subtank side, and the second sealing member seals a clearance formed between the recess and the projection.

Flaws in the conventional technology will be described below. Lately, from the viewpoint of environmental protection, some attempts have been made to use biological alcohol such as ethanol, mixed with gasoline. Alcohol blended fuel in which gasoline and alcohol are mixed at a given rate, or ethanol 100 percent fuel has high conductivity compared to conventional fuel such as gasoline. Therefore, when voltage is applied between the two male terminals which coexist in the recess formed on the first housing of the electric connector (between a positive terminal and a negative terminal), electric current leaks easily between the positive terminal and the negative terminal with the alcohol blended fuel or the ethanol 100 percent fuel serving as a medium of the leakage.

Particularly, if the positive terminal and the negative terminal coexist in the single recess formed on the first housing of the electric connector, a current path is formed via the alcohol blended fuel or the ethanol 100 percent fuel which has entered into the first housing along a bottom surface of the recess. As a result, electrochemical corrosion (electrolytic corrosion) is caused in both the terminals and eventually, break in electric continuity between each terminal of the electric connector and each terminal of the electric connector (coupler), or breakage is generated in the terminals. Such electrolytic corrosion is more easily produced as a distance between both the terminals which coexist in the recess on the first housing of the electric connector is shorter. However, simply by making large the distance between both the terminals, the connector joining device grows in size and accordingly, upsizing of the fuel supply system disposed in the fuel tank is caused. In the conventional fuel supply system, each terminal is constantly immersed in (exposed to) fresh fuel only with the effect of limiting the creepage surface leakage current, and fuel in the connector joining device circulates by vibration of a vehicle. Consequently, the electrolytic corrosion of each terminal of the electric connector and each terminal of the electric connector (coupler) becomes advanced, so that electric conduction between each terminal of the electric connector and each terminal of the electric connector (coupler) may not be kept normal. Furthermore, although a perfect water proof connector prevents the entering of fuel into each terminal of the electric connector and each terminal of the electric connector (coupler), respiratory effect is not produced because it is sealed, and thereby fuel may enter into the water proof connector due to a pressure difference. In addition, once fuel has entered, the fuel never drains out, so that the electrolytic corrosion of each terminal of the electric connector and each terminal of the electric connector (coupler) is caused.

SUMMARY OF THE INVENTION

The present invention addresses at least one of the above disadvantages.

According to the present invention, there is provided a fuel supply system for supplying fuel in a fuel tank to an injector of an internal combustion engine. The system includes a covering member, a subtank, a first housing, a plurality of terminals, a second housing, and a plurality of lead wires. The covering member covers an opening of the fuel tank. The subtank is disposed in the fuel tank. The first housing is formed on the covering member to project toward the subtank. The plurality of terminals is accommodated in the first housing. The second housing is fitted to the first housing. The plurality of lead wires is accommodated in the second housing and connected respectively to the plurality of terminals. The first housing includes a fitting recess and a partition wall. The fitting recess opens toward the subtank. The partition wall divides the fitting recess into a plurality of independent spaces, each of which receives a corresponding one of the plurality of terminals. The second housing includes a fitting projection, a slit, and a plurality of axial holes. The fitting projection is fitted into the fitting recess. The slit divides the fitting projection into a plurality of independent blocks, each of which receives a corresponding one of the plurality of terminals. The partition wall is inserted in the slit. Each of the plurality of axial holes accommodates a corresponding one of the plurality of lead wires. Each of the plurality of lead wires includes a corresponding one of a plurality of elastic seal members. Each of the plurality of elastic seal members seals a gap formed between an outer surface of a corresponding one of the plurality of lead wires and a peripheral wall surface of a corresponding one of the plurality of axial holes.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
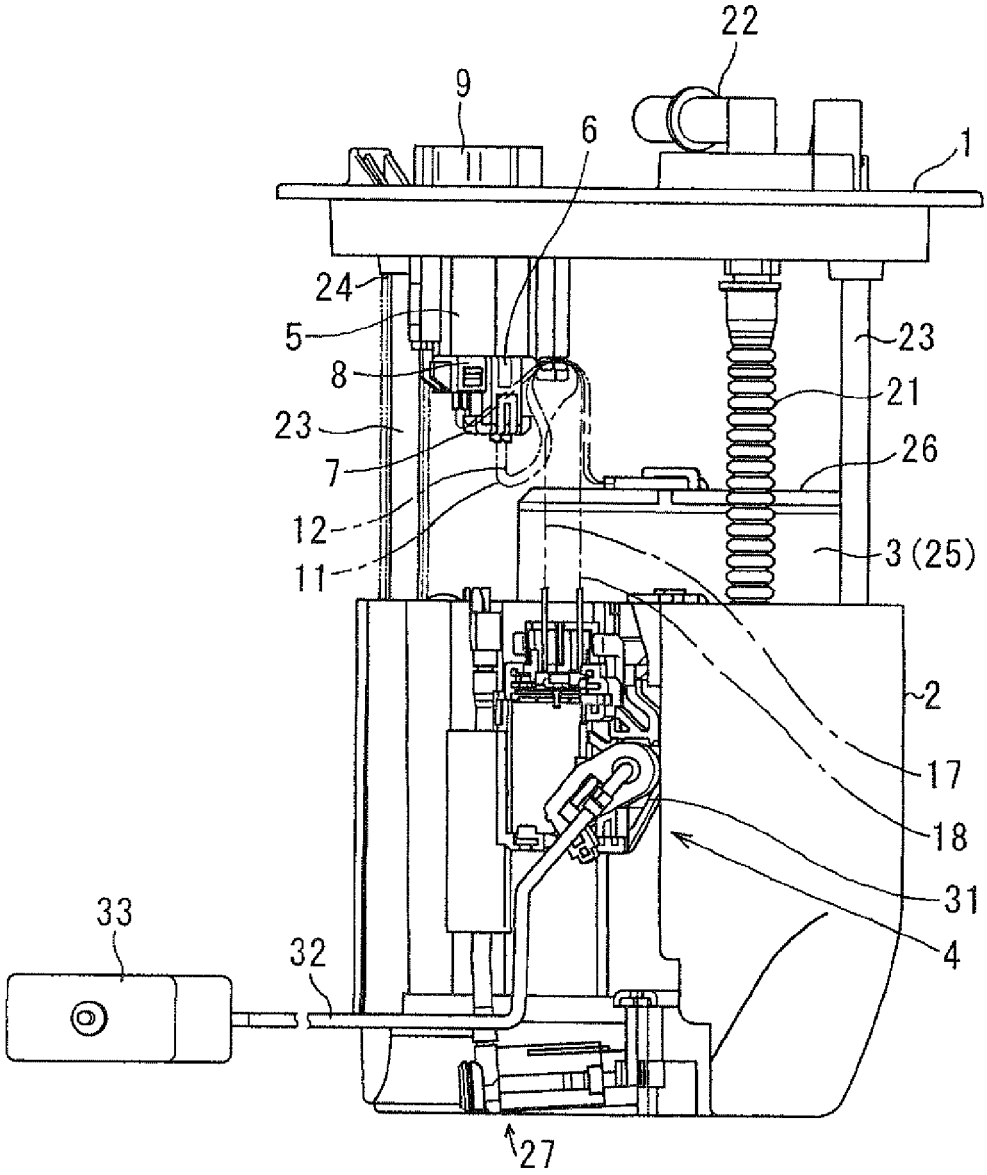
FIG. 1 is a front view illustrating a fuel supply system in accordance with an embodiment of the invention.

Structure of a fuel supply system of an embodiment will be described below with reference to FIGS. 1 to 3.

The fuel supply system of the present embodiment pressure-feeds and supplies fuel in a fuel tank into a fuel injection valve (injector) of an internal combustion engine (gasoline engine) at a predetermined pressure. A fuel storing chamber that stores fuel is formed in the fuel tank. An opening having a round shape is formed at an upper wall part of the fuel tank (tank upper wall part formed on an upper side of a vehicle such as an automobile in a vertical direction or a direction of gravitational force of the vehicle).

The fuel stored in the fuel storing chamber of the fuel tank is fuel, which includes a component having high electric conductivity, for example, high alcohol content blended fuel in which alcohol, such as ethanol, and gasoline are mixed at a given rate, bioethanol, and ethanol 100 percent fuel. In addition, low alcohol content blended fuel, gasoline, or diesel oil, for example, may be used as fuel.

The fuel supply system includes a flange (closing member) 1 and a subtank 2. The flange 1 serves as a covering member and is attached to an upper wall of the fuel tank to cover the opening of the fuel tank, and the subtank 2 is supported by the flange 1 and accommodated in the fuel storing chamber of the fuel tank. A pump module 3, a suction filter, and the like are accommodated in the subtank 2. The pump module 3 includes a fuel pump for discharging suctioned fuel and a cylindrical fuel filter arranged around this fuel pump. A sender gauge (fluid level detecting unit or a fuel remaining amount detecting means) 4 for detecting a surface level of fuel stored in the fuel storing chamber of the fuel tank, i.e., a remaining amount of fuel is attached on an outer surface of a side wall part of the subtank 2.

A primary electric connector is disposed on a lower surface of the flange 1 to project toward the subtank 2 (downward in the direction of gravitational force). Two secondary electric connectors are connected to the primary electric connector. The primary electric connector includes a connector housing (first housing) 5 formed on the lower surface of the flange 1 integrally therewith. Positive and negative terminals 11, 12, whose one end sides are embedded in the flange 1, two power source and output terminals (not shown), project into the inside of the connector housing 5.

One secondary electric connector of the two secondary electric connectors includes a connector housing (second housing) 6 that is to be fitted into the connector housing 5. Positive and negative terminals (not shown), which the positive and negative terminals 11, 12 are inserted into and connected to, and one-end portions (flange-side front end portions) of two lead wires 13, 14, which are connected to these positive and negative terminals, are accommodated and held in the connector housing 6. A cap 7 is fitted on a lower end portion (illustrated with FIGS. 1 to 3) of the connector housing 6 in an axial direction thereof. The cap 7 retains cylindrical rubber grommets 15, 16, which are arranged to surround the one-end portions of the two lead wires 13, 14 respectively in their circumferential directions.

The other secondary electric connector of the two secondary electric connectors includes a connector housing (second housing) 8 fitted to the connector housing 5. Two power source and output terminals (not shown), which the two power source and output terminals are inserted into and connected to, and one-end portions (flange side front end portions) of two lead wires 17, 18, which are connected to these power source and output terminals, are accommodated and held in the connector housing 8. A size H1 of the connector housing 6 in an axial direction thereof (height in the vertical direction in FIGS. 2 and 3) is larger than a size H2 of the connector housing 8 in an axial direction thereof (height in the vertical direction in FIG. 1).

An electric connector (connector for external connection) is disposed on an upper surface of the flange 1 to project to one side of the flange 1 which is opposite from the subtank 2 (upward in the direction of gravitational force). The electric connector is connected to a power source such as a battery, an engine control unit (ECU), or a fuel pump controller (FPC), for example, via a wire harness bundling together an electric wiring or lead wires. The electric connector includes a connector housing 9 formed on the upper surface of the flange 1 integrally therewith. A connector joining device of the present embodiment, which is configured by connecting the two secondary electric connectors to the primary electric connector on the flange side, will be described in greater detail hereinafter.

A fuel discharge pipe 22, into which fuel that is discharged from the fuel pump of the pump module 3 flows through a bellow pipe 21, is attached to the flange 1. The fuel discharge pipe 22 is a pipe through which the fuel discharged from the fuel pump is supplied to the outside of the fuel pump (a delivery pipe or an injector which is an engine side component). The flange 1 and the subtank 2 are connected by a shaft 23 extending in the vertical direction in FIG. 1 (direction of gravitational force, axial direction).

One end (upper end in the direction of gravitational force) of the shaft 23 in an axial direction thereof is press-fitted into the flange 1, and the other end (lower end in the direction of gravitational force) of the shaft 23 in the axial direction is loosely inserted into an insertion portion (not shown) which is formed in the subtank 2. A coil spring 24 that urges the flange 1 and the subtank 2 in a direction in which they are separated (vertical direction of the vehicle, vertical direction in FIG. 1) is provided around the shaft 23. Accordingly, the flange 1 that closes the upper wall opening of the fuel tank, and the subtank 2 in which the pump module 3 is accommodated, are reciprocated relative to each other in a direction of thickness of the flange 1, i.e., an axial direction of the shaft 23 (vertical direction illustrated in FIG. 1).

Therefore, even if a distance between a surface of the upper wall portion of the fuel tank and a bottom surface of a lower wall portion (bottom portion) of the fuel tank varies because of the expansion or contraction of the fuel tank as a result of the change of internal pressure or the change of a fuel amount due to temperature change, the subtank 2 is positioned in accordance with the positional variation of the inner wall of the bottom portion of the fuel tank, because a bottom portion of the subtank 2 is constantly pressed on an inner wall (bottom surface) of the bottom portion of the fuel tank by urging force (spring load) of the coil spring 24.

The subtank 2 is formed into a container shape whose flange side (upper side in FIG. 1) opens. The suction filter and the pump module 3 are accommodated in the subtank 2. The suction filter is connected to a suction port of the fuel pump. This suction filter is in contact with an inner wall (bottom surface) of the bottom portion of the subtank 2. An outer circumference of the suction filter is covered with a non-woven fabric, and the suction filter removes comparatively large foreign substances included in fuel, which is suctioned from the inside of the fuel storing chamber of the subtank 2 by the fuel pump.

The pump module 3 includes the fuel filter, the fuel pump and a pressure regulator. The fuel filter includes a filter case having a case main body 25 and a cover 26, and a cylindrical filter element, and covers a radially outer portion of the fuel pump in a circumferential direction thereof. The case main body 25 and the cover 26 are fixed together by welding, for example. An inflow port of the case main body 25 is fitted to a discharge port of the fuel pump. A check valve for preventing a backflow of fuel to the fuel pump is accommodated in the inflow port of the case main body 25. The filter element removes foreign substances included in fuel discharged from the discharge port of the fuel pump.

The fuel pump is an in-tank type electric fuel pump (electric rotary pump) disposed in the fuel tank, and the fuel pump pumps up (suctions) fuel stored in the fuel storing chamber of the subtank 2 and discharges the fuel under high pressure, by rotating a pump part (turbine pump) by driving force of a motor part (brush-less motor). This fuel pump is accommodated longitudinally in the subtank 2 with its fuel discharge side located upward in the direction of gravitational force, and with its fuel suction side located downward in the direction of gravitational force. The pump part of the fuel pump is disposed on a lower end side of a metal housing which opens at its both ends in the axial direction. The motor part of the fuel pump is disposed at an intermediate portion of the housing. An end cover made of synthetic resin is disposed on an upper end side of the housing (upper end side of the pump module 3 in FIG. 1). A connector area, which is connected to the positive and negative terminals 11, 12 of the primary electric connector via the positive and negative terminals of the secondary electric connector and the lead wires 13, 14, is provided at this end cover.

The pressure regulator regulates pressure of fuel, which is discharged from the fuel pump and foreign substances of which are removed through the filter element of the fuel filter. Fuel whose pressure has been regulated at the pressure regulator is led into the injectors through the bellow pipe 21, the fuel discharge pipe 22, a fuel feeding pipe outside the tank, and the delivery pipe so as to be injected into a combustion chamber or an intake port for each cylinder of the engine through each injector.

High pressure fuel drawn along a pressure rising part by the fuel pump is supplied into a jet pump 27 which supplies fuel into the fuel storing chamber of the subtank 2, and the jet pump 27 spouts out this high pressure fuel through a nozzle toward a suction port of the subtank 2. In addition, surplus fuel discharged from the pressure regulator may be spouted out through the nozzle toward the suction port of the subtank 2. The jet pump 27 supplies fuel stored in the fuel storing chamber of the fuel tank into the fuel storing chamber of the subtank 2 using suction force generated by the ejection of fuel. Accordingly, even when an amount of fuel in the fuel storing chamber of the fuel tank decreases, the fuel storing chamber of the subtank 2 is filled with fuel.

The sender gauge 4 for detecting a remaining amount of fuel stored in the fuel tank is disposed outside the subtank 2. As illustrated with FIG. 1, the sender gauge 4 includes a sensor part 31, a float arm 32 that pivots on its sensor part-side end portion, and a float 33 that is attached to a front end of the float arm 32. The float 33 floats on fuel in the fuel storing chamber of the fuel tank.

Conductive patterns having different electric resistance values are formed in the sensor part 31. An end portion of the float arm 32 on the opposite side of the float arm 32 from the float 33 is contactable with the conductive pattern of the sensor part 31. When the float 33 that floats on fuel in the fuel storing chamber of the fuel tank moves in accordance with a level position of fuel, the float arm 32 pivots in accordance with the movement of the float 33. Consequently, a contact state between the float arm 32 and the conductive pattern of the sensor part 31 changes, so that the level position of fuel in the fuel storing chamber of the fuel tank, i.e., a remaining amount of fuel in the fuel storing chamber of the fuel tank, is detected. The remaining amount of fuel detected by the sender gauge 4 is outputted as an electrical signal from the electric connector to the ECU via the lead wires 17, 18, the output terminal of the secondary electric connector, and the output terminal of the primary electric connector.

Next, the connector joining device of the present embodiment will be described below in detail with reference to FIGS. 1 to 3. The connector joining device includes the primary electric connector disposed on the lower surface of the flange 1, and the two secondary electric connectors connected to the primary electric connector. The primary electric connector includes the connector housing (first housing) 5, the positive and negative terminals (male terminals) 11, 12, and two power source and output terminals (male terminals). The connector housing (first housing) 5 is formed in a shape of a rectangular cylinder, and formed integrally with the flange 1 so as to project from the lower surface of the flange 1 to the subtank side (lower side in the direction of gravitational force). One end sides of the positive and negative terminals 11, 12 project into the connector housing 9 of the electric connector disposed on the upper surface of the flange 1, and the other end sides of the positive and negative terminals 11, 12 project into the connector housing 6.

The connector housing 5 has a rectangular cylindrical wall projecting from the lower surface of the flange 1 to the subtank side (lower side in the direction of gravitational force). A first fitting recess 35 and a second fitting recess (not shown) are formed on this rectangular cylindrical wall. Connecting portions of the first fitting recess 35 that open toward the subtank and that extend in the axial directions of the positive and negative terminals 11, 12 project (are exposed) respectively. Connecting portions of the second fitting recess that open toward the subtank and that extend in the axial directions of the two power source and output terminals project (are exposed) respectively. The connector housing 5 has a partition wall (dividing wall) 36 and a partition wall (dividing wall: not shown). The partition wall 36 divides the first fitting recess 35 between independent spaces for each of the positive and negative terminals 11, 12. The partition wall (not shown) divides off the second fitting recess into independent spaces (fitting recesses) for each of the power source and output terminals. A partition wall 37 of the rectangular cylindrical wall which has the same height as the partition wall 36 and which is an outer wall of the first fitting recess 35 also serves as the dividing wall. A partition wall of the rectangular cylindrical wall which has the same height as the partition wall and which is an outer wall of the second fitting recess also serves as the dividing wall.

The partition wall 36 is disposed to project toward the subtank such that the partition wall 36 divides a space (fitting recess) 41, in which the one positive terminal 11 of the positive and negative terminals 11, 12 is accommodated with the terminal 11 being exposed, from a space (fitting recess) 42, in which the other negative terminal 12 of the positive and negative terminals 11, 12 is accommodated with the terminal 12 being exposed. The partition wall is disposed to project toward the subtank such that the partition wall divides a space (fitting recess), in which the power source terminal of the two power source and output terminals is accommodated, from a space (fitting recess), in which the output terminal of the two power source and output terminals is accommodated. An engagement hole 44 for snap-fit joint between the positive and negative terminals (male terminals) 11, 12 whose one end sides project into the connector housing 9 of the electric connector disposed on the upper surface of the flange 1 and whose other end sides project into the connector housing 6, and the two power source and output terminals (male terminals) is formed in an outer wall 43. An upper hole wall surface of the engagement hole 44 illustrated in FIGS. 2, 3 is level, whereas a lower hole wall surface of the engagement hole 44 is an inclined tapered surface such that an opening sectional area of the hole 44 gradually increases from the inside toward the outside of the outer wall 43.

The secondary electric connector on one side (fuel pump side) includes the connector housing (second housing) 6, the positive and negative terminals (female terminals), and the two lead wires 13, 14. The connector housing 6 in a shape of a rectangular cylinder, is fitted to the connector housing 5. The positive and negative terminals are accommodated and held in a first fitting projection 49 of this connector housing 6. This secondary electric connector is connected to the connector area of the fuel pump of the pump module 3 via the lead wires 13, 14. Accordingly, electric power from the power source is supplied to the fuel pump via the lead wires 13, 14.

The connector housing 6 includes a rectangular cylindrical wall projecting from the subtank side toward the bottom surface of the flange 1 (upward in the direction of gravitational force) so as to be opposed to the bottom surface of the flange 1, i.e., a bottom surface of the rectangular cylindrical wall of the connector housing 5. The first fitting projection 49, which is fitted into the first fitting recess 35 of the connector housing 5, is formed on this rectangular cylindrical wall. The connector housing 6 includes a slit 53 which divides the first fitting projection 49 into two independent blocks 51, 52 for each of the positive and negative terminals into which the positive and negative terminals 11, 12 are respectively inserted. This slit 53 opens toward the bottom surface of the flange 1, i.e., toward the bottom surface of the rectangular cylindrical wall of the connector housing 5. The partition wall 36 of the connector housing 5 is loosely fitted into the slit 53. A top surface of the partition wall 36 of the connector housing 5 is brought into contact with a bottom surface of the slit 53 on its closed end side. The connector housing 6 includes two axial direction holes 54, 55 which respectively accommodate the two lead wires 13, 14.

The block 51 includes at least a hollow part which opens toward the bottom surface of the flange 1, i.e., toward the bottom surface of the rectangular cylindrical wall of the connector housing 5, and which extends in the axial direction. A positive terminal, or at least a pressure-welding part of the positive terminal (pressure-welding part holding a connecting portion of the positive terminal 11 from its both sides, for example) is accommodated and held in this hollow part. An engaging claw 56 projecting from a lateral surface (left-hand side surface) of the block 51 to the left-hand side in FIG. 3 is provided on the block 51. The block 52 includes at least a hollow part which opens toward the bottom surface of the flange 1, i.e., toward the bottom surface of the rectangular cylindrical wall of the connector housing 5, and which extends in the axial direction. A negative terminal, or at least a pressure-welding part of the negative terminal (pressure-welding part holding a connecting portion of the negative terminal 12 from its both sides, for example) is accommodated and held in this hollow part. An engaging claw 57 projecting from a lateral surface (right-hand side surface) of the block 52 to the right-hand side in FIG. 3 is provided on the block 52.

The axial direction hole 54 is a lead insertion hole (bag hole or through hole) that opens on a lower surface of the block 51 of the connector housing 6 and that accommodates one end portion (connector insertion portion) 58 of the lead wire 13. This axial direction hole 54 includes an accommodating recess 61 accommodating the rubber grommet 15 therein, on its open end side which is its subtank side. A level difference 62 having an annular shape is defined between this accommodating recess 61 and a small diameter hole of the axial direction hole 54 formed on an upper side (FIGS. 2, 3) of the accommodating recess 61. The rubber grommet 15 for sealing a cylindrical clearance, which is defined between an outer circumferential surface of the connector insertion portion 58 of the lead wire 13 and a hole wall surface of the accommodating recess 61, is fitted in the axial direction hole 54.

The axial direction hole 55 is a lead insertion hole (bag hole or through hole) that opens on a lower surface of the block 52 of the connector housing 6 and that accommodates one end portion (connector insertion portion) 59 of the lead wire 14. This axial direction hole 55 includes an accommodating recess 63 accommodating the rubber grommet 16 therein, on its open end side which is its subtank side. A level difference 64 having an annular shape is defined between this accommodating recess 63 and a small diameter hole of the axial direction hole 55 formed on an upper side (FIGS. 2, 3) of the accommodating recess 63. The rubber grommet 16 for sealing a cylindrical clearance, which is defined between an outer circumferential surface of the connector insertion portion 59 of the lead wire 14 and a hole wall surface of the accommodating recess 63, is fitted in the axial direction hole 55.

An elastic engagement claw 67 is provided for one block 51 of the two blocks 51, 52 to project in an L-shape from a lateral surface (left-hand side surface) of the vicinity of its front end surface (top surface). An engaging claw 68, which is in engagement with the engagement hole 44 formed in the outer wall 43 of the rectangular cylindrical wall of the connector housing 5, is formed on a side surface (left-hand side surface) of the elastic engagement claw 67. Accordingly, when the terminals and the lead wires are connected by fitting the fitting projection, which is provided for the second housing of the secondary electric connector, into the fitting recess, which is formed on the first housing of the primary electric connector, the engaging claw formed on the elastic engagement claw is engaged with the engagement hole formed in the first housing, so that the first housing and the second housing are joined together through snap-fitting and are not easily separated. A pressed part 69, which an operator presses in releasing the engaging claw 68 from the engagement hole 44, is formed at an front end portion of the elastic engagement claw 67 in its axial direction. As a result, when an operator presses the pressed part, the snap-fit joint between the first housing of the primary electric connector and the second housing of the secondary electric connector is easily released.

The U-shaped cap 7 for retaining the rubber grommets 15, 16 is fitted on a lower end portion of the connector housing 6. Accordingly, even if the axial direction holes of the second housing open toward the subtank (downward in the direction of gravitational force), for instance, the elastic seal members for respectively sealing the clearances formed between the wall surfaces of the axial direction holes of the second housing and the lead wires do not fall out of (the inside of) the secondary electric connector toward the subtank (downward in the direction of gravitational force). The cap 7 includes a tabular plate 73 and opposing wall parts 74, 75. Through holes 71, 72, through which the lead wires 13, 14 respectively pass, are formed in the tabular plate 73, and the tabular plate 73 closes opening sides of the cylindrical clearances. The opposing wall parts 74, 75 are formed by bending both right-hand and left-hand end portions (FIGS. 2, 3) of the plate 73 toward the flange side so as to be opposed to right and left side surfaces of the connector housing 6. Engagement holes 78, 79, with which the engaging claws 56, 57 that are provided on the side surfaces of the blocks 51, 52 of the connector housing 6 are respectively in engagement, are formed in the opposing wall parts 74, 75. Consequently, when the cap is attached on the second housing of the secondary electric connector, the engagement holes formed in the opposing wall parts of the cap are engaged respectively with the engaging claws formed on the side surfaces of the second housing, so that the cap is fixed to the second housing and not easily separated.

The secondary electric connector on the other side (sender gauge side) includes the connector housing (second housing) 8, two power source and output terminals (female terminals), and the two lead wires 17, 18. The connector housing 8 in a shape of a rectangular cylinder, is fitted to the connector housing 5. The two power source and output terminals are accommodated and held in a second fitting projection of this connector housing 8. As a result, the remaining amount of fuel detected by the sender gauge 4 is outputted as an electrical signal from the primary electric connector 5 to the ECU disposed outside of the fuel tank via the lead wire 18 and the secondary and primary electric connectors 8, 5.

The connector housing 8 includes a rectangular cylindrical wall projecting from the subtank side toward the bottom surface of the flange 1 (upward in the direction of gravitational force) so as to be opposed to the bottom surface of the flange 1, i.e., a bottom surface of the rectangular cylindrical wall of the connector housing 5. The second fitting projection, which is fitted into the second fitting recess of the connector housing 5, is formed on this rectangular cylindrical wall. The connector housing 8 includes a slit that divides the second fitting projection between two independent blocks for each of the two power source and output terminals, in which the two power source and output terminals are inserted, and two axial direction holes that accommodate the two lead wires 17, 18. The slit and the two axial direction holes have a similar structure to the connector housing 6.

The positive and negative terminals 11, 12 of the primary electric connector are male terminals which are connected to the positive and negative terminals (female terminals) of the secondary electric connector and the two lead wires 13, 14. The positive terminal 11 of the primary electric connector is inserted into the positive terminal of the secondary electric connector so as to be held by the pressure-welding part from both sides of the terminal 11. Consequently, the positive terminal 11 is connected to the positive terminal, i.e., the pressure-welding part of the positive terminal is crimped against the connecting portion of the positive terminal 11. Electric connection is made and at the same time, mechanical coupling is made between the positive terminal 11 and the positive terminal. The negative terminal 12 of the primary electric connector is inserted into the negative terminal of the secondary electric connector so as to be held by the pressure-welding part from both sides of the terminal 12. Consequently, the negative terminal 12 is connected to the negative terminal, i.e., the pressure-welding part of the negative terminal is crimped against the connecting portion of the negative terminal 12. Electric connection is made and at the same time, mechanical coupling is made between the negative terminal 12 and the negative terminal. A connecting portion between the positive and negative terminals (female terminals) and the two lead wires 13, 14 may be embedded in the connector housing 6 by insert molding.

The power source and output terminals of the primary electric connector are male terminals, which are connected to the power source and output terminals (female terminals) and the two lead wires 17, 18 of the secondary electric connector. The power source terminal of the primary electric connector is inserted into the power source terminal of the secondary electric connector so as to be held by the pressure-welding part from both sides of the power source terminal. Consequently, the power source terminal is connected to the power source terminal, i.e., the pressure-welding part of the power source terminal is crimped against the connecting portion of the power source terminal. Electric connection is made and at the same time, mechanical coupling is made between the power source terminal and the power source terminal. The output terminal of the primary electric connector is inserted into the output terminal of the secondary electric connector so as to be held by the pressure-welding part from both sides of the output terminal. Consequently, the output terminal is connected to the output terminal, i.e., the pressure-welding part of the output terminal is crimped against the connecting portion of the output terminal. Electric connection is made and at the same time, mechanical coupling is made between the output terminal and the output terminal. A connecting portion between the two power source and output terminals (female terminals) and the two lead wires 17, 18 may be embedded in the connector housing 8 by insert molding.

The two rubber grommets 15, 16 are cylindrical elastic seal members, which are inserted respectively into the cylindrical clearances formed between outer circumferential surfaces of the connector insertion portions 58, 59 of the two lead wires 13, 14 and the hole wall surfaces of the accommodating recesses 61, 63, from a lower surface side of the connector housing 6 of the secondary electric connector (lower side in the direction of gravitational force, subtank side), i.e., from opening sides of the axial direction holes 54, 55 (opening sides of the accommodating recesses 61, 63), so as to be attached to the connector housing 6. The rubber grommet 15 is cylindrically formed from synthetic rubber. An upper annular end surface of the rubber grommet 15 in its axial direction is in contact with the level difference 62. An lower annular end surface of the rubber grommet 15 in its axial direction is located on generally the same level as a lower surface of the block 51 of the connector housing 6, and is exposed toward the subtank on the lower surface of the block 51. A hole wall surface of a through hole 76, which passes through the rubber grommet 15 in its axial direction, is closely-attached on the outer circumferential surface of the connector insertion portion 58 of the lead wire 13. An outer circumferential surface (cylindrical surface) of the rubber grommet 15 is closely-attached on the hole wall surface of the accommodating recess 61.

The rubber grommet 16 is cylindrically formed from synthetic rubber. An upper annular end surface of the rubber grommet 16 in its axial direction is in contact with the level difference 64. An lower annular end surface of the rubber grommet 16 in its axial direction is located on generally the same level as a lower surface of the block 52 of the connector housing 6, and is exposed toward the subtank on the lower surface of the block 52. A hole wall surface of a through hole 77, which passes through the rubber grommet 16 in its axial direction, is closely-attached on the outer circumferential surface of the connector insertion portion 59 of the lead wire 14. An outer circumferential surface (cylindrical surface) of the rubber grommet 16 is closely-attached on the hole wall surface of the accommodating recess 63.

Operation of the connector joining device that is used for the fuel supply system of the present embodiment will be briefly described below with reference to FIGS. 1 to 3.

When connecting the connector housing 6 of the secondary electric connector that accommodates and holds the positive and negative terminals, the two lead wires 13, 14, and the two rubber grommets 15, 16, to the connector housing 5 of the primary electric connector that is formed integrally with the flange 1 which closes the opening of the fuel tank, the cap 7 with the two lead wires 13, 14 inserted therein in advance, is first attached on the lower end portion of the connector housing 6. Alternatively, the cap 7 may be attached on the lower end portion of the connector housing 6 after connecting the primary electric connector and the secondary electric connector. After that, the first fitting projection 49 of the connector housing 6 is inserted into the first fitting recess 35 of the connector housing 5. As a result, the two blocks 51, 52, which are divided from each other by the slit 53, are fitted respectively into the two spaces 41, 42 which are divided from each other by the partition wall 36. Meanwhile, the engaging claw 68 of the elastic engagement claw 67 formed on the block 51 of the connector housing 6 is engaged with the engagement hole 44 formed in the outer wall 43 of the rectangular cylindrical wall of the connector housing 5.

Connecting portions of the positive and negative terminals 11, 12, which project respectively into the spaces 41, 42 of the connector housing 5 of the primary electric connector, are connected respectively to the positive and negative terminals, which are held in the blocks 51, 52 of the connector housing 6 of the secondary electric connector. Accordingly, the connecting portions of the positive and negative terminals 11, 12 are crimped respectively by the pressure-welding parts of the positive and negative terminals. As a result, electric connections are made, and at the same time, mechanical couplings are made respectively between the positive and negative terminals 11, 12 on the primary electric connector side and the positive and negative terminals on the secondary electric connector side. The connection of the connector housing 8 of the secondary electric connector to the connector housing 5 of the primary electric connector is similarly carried out. Consequently, electric connections are made and at the same time, mechanical couplings are made respectively between the power source terminal and the output terminal on the primary electric connector side and the power source terminal and the output terminal on the secondary electric connector side.

Because the connector joining device of the present embodiment is disposed to project from the lower surface of the flange 1 to the inside of the fuel tank, the joining device may be immersed in fuel. In such a case, fuel may enter through an opening (openings of the spaces 41, 42) that opens at an end portion of the rectangular cylindrical wall of the connector housing 5 of the primary electric connector, which is indicated by an arrow A in FIG. 2. The fuel, which has entered from the opening, enters into the bottom surface of the connector housing 5 (bottom surfaces of the spaces 41, 42) along an inner wall surface of the rectangular cylindrical wall of the connector housing 5.

The fuel, which has reached the bottom surface of the connector housing 5, enters into the axial direction holes 54, 55 of the connector housing 6 of the secondary electric connector along the positive terminal 11 or the negative terminal 12 on the primary electric connector side, and the positive terminal or the negative terminal on the secondary electric connector side. The fuel that has entered into the axial direction holes 54, 55 of the connector housing 6 is blocked and stopped in the small diameter holes of the axial direction holes 54, 55, and is prevented from entering into the lower surface side of the connector housing 6, since the cylindrical clearances formed respectively between the outer circumferential surfaces of the connector insertion portions 58, 59 of the two lead wires 13, 14, and the hole wall surfaces of the accommodating recesses 61, 63 formed on the opening sides of the axial direction holes 54, 55, are sealed with the rubber grommets 15, 16.

Figure 2:
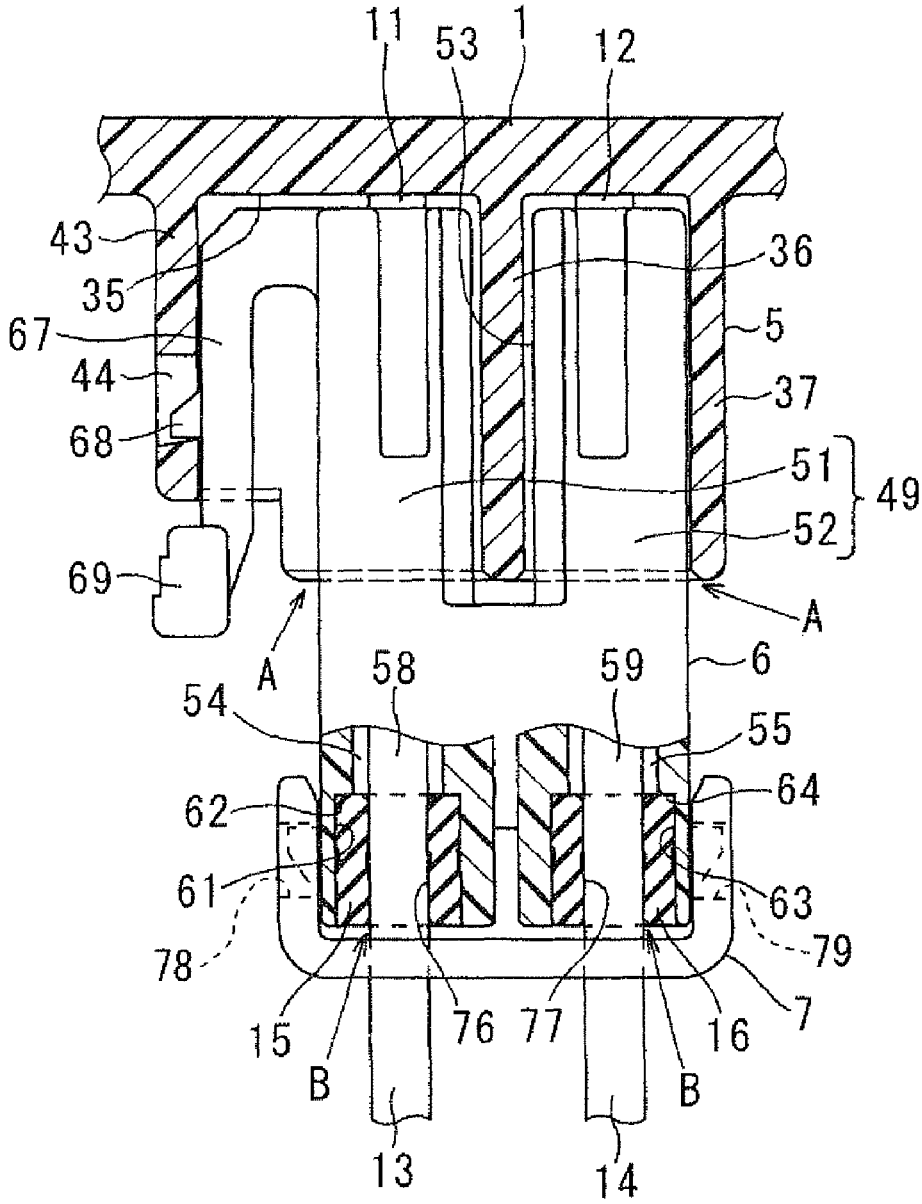
FIG. 2 is a sectional view illustrating a connector joining device in accordance with the embodiment.
Figure 3:
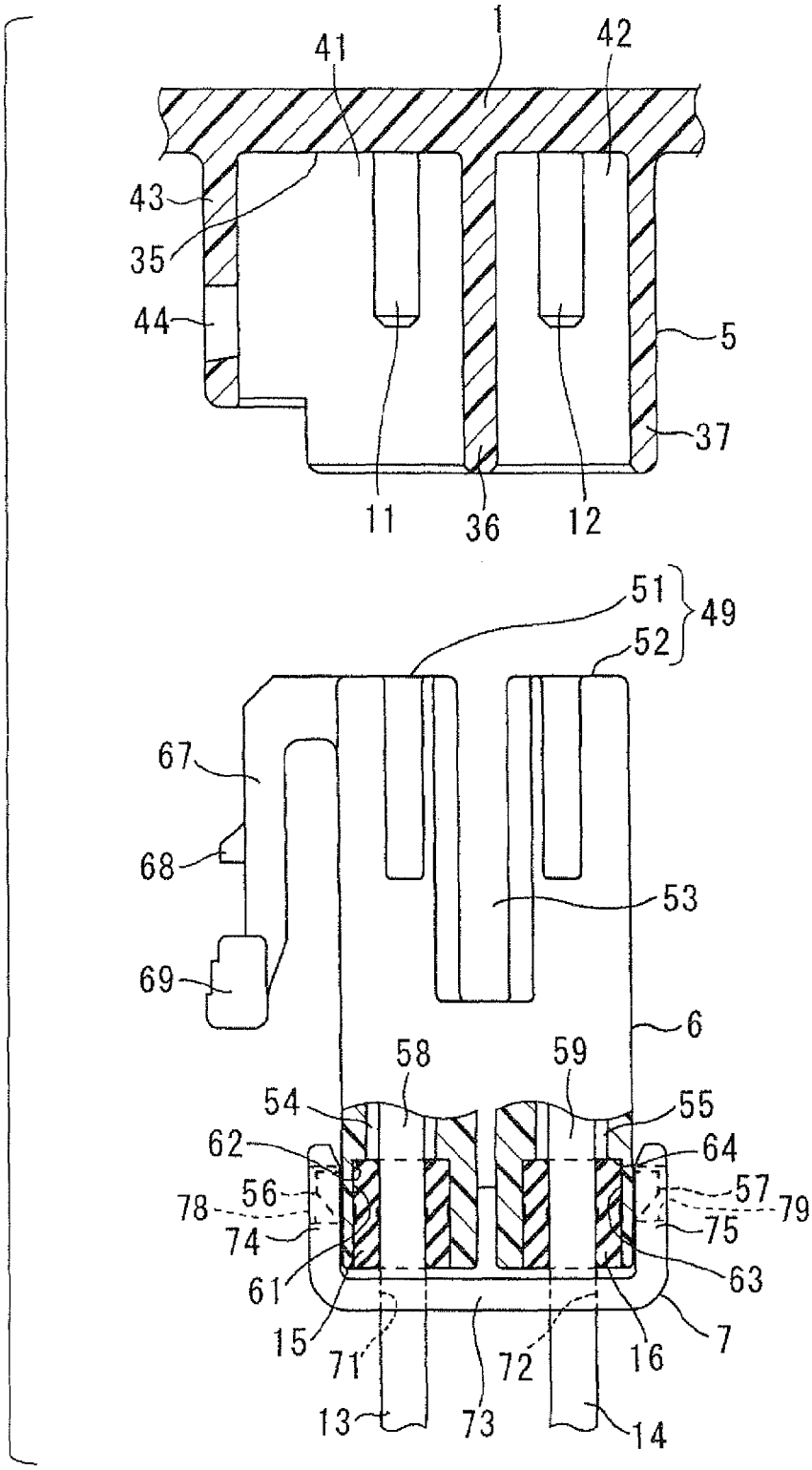
FIG. 3 is an exploded view illustrating the connector joining device in accordance with the embodiment.

Therefore, an outflow of the fuel, which has entered into the connector joining device through the openings indicated by an arrow A in FIG. 2, from the openings indicated by an arrow B in FIG. 2 (openings of the accommodating recesses 61, 63 that open on the lower surface of the connector housing 6) via the positive terminal 11 or the negative terminal 12 on the primary electric connector side, and the positive terminal or the negative terminal on the secondary electric connector side, i.e., circulation of fuel to the positive terminal 11 or the negative terminal 12 on the primary electric connector side, and then to the positive terminal or the negative terminal on the secondary electric connector side, is prevented. Conversely, an outflow of the fuel, which has entered through the openings indicated by an arrow B in FIG. 2, from the openings indicated by an arrow A in FIG. 2 via the positive terminal or the negative terminal on the secondary electric connector side, and the positive terminal 11 or the negative terminal 12 on the primary electric connector side, i.e., circulation of fuel to the positive terminal or the negative terminal on the secondary electric connector side, and then to the positive terminal 11 or the negative terminal 12 on the primary electric connector side, is also prevented. In addition, when cylindrical rubber grommets are attached respectively between hole wall surfaces of axial direction holes of the connector housing 8 of the secondary electric connector, and outer circumferences of the lead wires 17, 18, circulation of fuel to the power source terminal or the output terminal on the primary electric connector side, and then to the power source terminal or the output terminal on the secondary electric connector side, is similarly prevented.

Advantageous effects of the fuel supply system in accordance with the embodiment will be described below. As described above, in the case of the connector joining device that is used for the fuel supply system of the present embodiment, the partition walls 36, 37 are provided for the connector housing 5 of the primary electric connector. The partition walls 36, 37 divide the first fitting recess 35 of the housing 5 between the space 41, in which the positive terminal 11 is accommodated with the terminal 11 exposed, and the space 42, in which the negative terminal 12 is accommodated with the terminal 12 exposed. The slit 53 is provided for the connector housing 6 of the secondary electric connector, which is connected to the primary electric connector. The slit 53 divides the first fitting projection 49, which is fitted into the first fitting recess 35 of the connector housing 5, into the two independent blocks 51, 52 for each of the positive and negative terminals 11, 12 and for each of the positive and negative terminals. Accordingly, the clearance, which is defined between the bottom face of the first fitting recess 35 of the connector housing 5 and the top surface of the first fitting projection 49 of the connector housing 6, is formed into a serpentine shape meandering in a horseshoe shape or in a U-shape, by the partition walls 36, 37, or particularly, the partition wall 36 and the slit 53.

As a result, a creepage distance for insulation between the positive and negative terminals 11, 12 accommodated in the first fitting recess 35 of the connector housing 5 is made longer than when there are not the partition walls 36, 37 or the slit 53, i.e., when the positive and negative terminals coexist in a single fitting recess. Thus, by forming the partition wall 36 inside the first fitting recess 35 of the primary electric connector and by providing the slit 53, into which the partition wall 36 is inserted, between the two blocks 51, 52 which compose the first fitting projection 49 of the secondary electric connector, the creepage distance for insulation between the positive and negative terminals 11, 12 is made larger (longer) without changing an insulation spatial distance between the positive and negative terminals 11, 12.

Consequently, the generation of failure of the connector joining device, i.e., electrolytic corrosion of the positive and negative terminals 11, 12 or the positive and negative terminals, due to the fuel that has entered into a clearance formed between the bottom face of the first fitting recess 35 of the connector housing 5, and the first fitting projection 49 of the connector housing 6, is limited. As a consequence of this, even when a high conductivity component is included in fuel (e.g., highly-concentrated alcohol blended fuel in which alcohol, such as ethanol, and gasoline are mixed at a given rate, bloethanol, and ethanol 100 percent fuel), the effect of limiting the creepage surface leakage current is produced without the upsizing of the fuel supply system having the connector joining device. Therefore, the electrolytic corrosion of the positive and negative terminals 11, 12 or the positive and negative terminals is curbed. Accordingly, generation of break in electric continuity between the positive and negative terminals 11, 12 or the positive and negative terminals, and the lead wires 13, 14 on the secondary electric connector side, or breakage is restrained.

In the connector joining device of the present embodiment, in order to prevent the entering of fuel from the lower surface side of the connector housing 6 of the secondary electric connector (lower side in the direction of gravitational force, subtank side) into the positive and negative terminals 11, 12 or the positive and negative terminals, the cylindrical rubber grommets 15, 16 are attached respectively between the hole wall surfaces of the accommodating recesses 61, 63 of the connector housing 6 of the secondary electric connector, and the outer circumferential surfaces of the lead wires 13, 14. In order to prevent separation (falling) of the rubber grommets 15, 16, the U-shaped cap 7 having the plate 73 that closes opening sides of the cylindrical clearances is added on the lower end portion of the connector housing 6 of the secondary electric connector, and the partition wall 36 whereby the spaces 41, 42 are divided off from each other for each of the positive and negative terminals 11, 12 is also provided. The spaces 41, 42 respectively accommodate the positive and negative terminals 11, 12 projecting from the bottom face of the first fitting recess 35 of the connector housing 5 of the primary electric connector on the flange side.

Hence, the circulation of fuel to the positive and negative terminals 11, 12 or the positive and negative terminals, which are accommodated and held inside the first fitting recess 35 of the connector housing 5 of the primary electric connector as well as inside the first fitting projection 49 of the connector housing 6 of the secondary electric connector, is prevented. As a result, the progression of the electrolytic corrosion of the positive and negative terminals 11, 12 or the positive and negative terminals is delayed, so that electric conduction between the positive and negative terminals 11, 12 or the positive and negative terminals, and the lead wires 13, 14 on the secondary electric connector side is kept normal.

(Modifications)

In the present embodiment, the lead wires 13, 14 on the positive and negative electrode sides connecting the secondary electric connector and the pump module 3, are accommodated in the axial direction holes 54, 55 of the secondary electric connector, which is connected to the primary electric connector. Alternatively, the lead wires 17, 18 on the power source side and output side connecting the secondary electric connector and the sender gauge 4, may be accommodated in the axial direction holes 54, 55 of the secondary electric connector.

In the present embodiment, the rubber grommets 15, 16 on the positive and negative electrode sides are accommodated in the accommodating recesses 61, 63 formed on the opening sides of the axial direction holes 54, 55 of the secondary electric connector, which is connected to the primary electric connector. Alternatively, grommets (elastic seal members) may be accommodated respectively in intermediate portions of the axial direction holes 54, 55 of the secondary electric connector in axial directions thereof. Furthermore, inner diameters may be generally the same between the small diameter holes of the axial direction holes 54, 55, and the accommodating recesses 61, 63. In the present embodiment, both the secondary electric connector on the pump module side and the secondary electric connector on the sender gauge side are connected to the primary electric connector on the flange side. Alternatively, the secondary electric connector on the pump module side or the secondary electric connector on the sender gauge side may be connected to the primary electric connector.

Additional advantages and modifications will readily occur to those skilled in the art. The invention in its broader terms is therefore not limited to the specific details, representative apparatus, and illustrative examples shown and described.

What is claimed is:

1. A fuel supply system for supplying fuel in a fuel tank to an injector of an internal combustion engine, the system comprising:

a covering member covering an opening of the fuel tank;

a subtank disposed in the fuel tank;

a first housing formed on the covering member to project toward the subtank;

a plurality of terminals accommodated in the first housing;

a second housing fitted to the first housing; and a plurality of lead wires accommodated in the second housing and connected respectively to the plurality of terminals, wherein:

the first housing includes:

a fitting recess that opens toward the subtank; and a partition wall that divides the fitting recess into a plurality of independent spaces, each of which receives a corresponding one of the plurality of terminals;

the second housing includes:

a fitting projection fitted into the fitting recess, a narrow clearance through which fuel can circulate being defined between a top surface of the fitting projection of the second housing and a bottom face of the fitting recess of the first housing;

a slit that divides the fitting projection into a plurality of independent blocks, each of which receives a corresponding one of the plurality of terminals, the partition wall being inserted in the slit; and a plurality of axial holes, each of which accommodates a corresponding one of the plurality of lead wires; and each of the plurality of lead wires includes a corresponding one of a plurality of elastic seal members, each of the plurality of elastic seal members sealing a gap formed between an outer surface of a corresponding one of the plurality of lead wires and a peripheral wall surface of a corresponding one of the plurality of axial holes.

2. The fuel supply system according to claim 1, further comprising a pump module that is accommodated in the subtank to suction and discharge fuel.

3. The fuel supply system according to claim 2, wherein the plurality of lead wires connects the plurality of terminals to the pump module.

4. The fuel supply system according to claim 1, further comprising a fuel remaining amount detecting means disposed in the subtank for detecting a remaining amount of fuel in the fuel tank.

5. The fuel supply system according to claim 4, wherein the plurality of lead wires connects the plurality of terminals to the fuel remaining amount detecting means.

6. The fuel supply system according to claim 1, wherein:

the plurality of terminals includes first and second terminals projecting into the fitting recess;

the plurality of independent spaces includes a first space in which the first terminal is accommodated, and a second space in which the second terminal is accommodated; and the partition wall projects toward the subtank to divide the first space from the second space.

7. The fuel supply system according to claim 1, wherein:

the first housing further includes an engagement hole; and the second housing further includes an engagement claw portion, which is resiliently bendable relative to the engagement hole and includes:

an engaging claw that is snap-fitted into the engagement hole; and a presser part that is pressable to disengage the engaging claw from the engagement hole.

8. The fuel supply system according to claim 1, further comprising a cap that retains the plurality of elastic seal members so that the plurality of elastic seal members does not fall out of the gap.

9. The fuel supply system according to claim 8, wherein:

the plurality of axial holes opens toward the subtank; and each of the plurality of elastic seal members is a cylindrical grommet which is inserted into the gap through a corresponding opening of the plurality of axial holes and is thereby attached to the second housing, the cap covering an opening side of the gap.

10. The fuel supply system according to claim 8, wherein:

the second housing further includes an engaging claw projecting from a lateral surface of the second housing; and a wall of the cap, which is opposed to the lateral surface of the second housing, includes an engagement hole, which is engaged with the engaging claw of the second housing.

* * * * *